US005512718A

United States Patent [19]

Larose

[11] Patent Number: 5,512,718

[45] Date of Patent: Apr. 30, 1996

[54] KEYPAD HAVING A REFLECTIVE CONTACT

[75] Inventor: Charles W. Larose, Kokomo, Ind.

[73] Assignee: Delco Electronics Corporation, Kokomo, Ind.

[21] Appl. No.: 323,326

[22] Filed: Oct. 14, 1994

[51] Int. Cl.[6] ..... H01H 9/00

[52] U.S. Cl. ..... 200/314; 200/313; 200/310; 200/DIG. 47

[58] Field of Search ..... 200/310, 311, 200/312, 313, 314, 315, 316, 308, 309, 317, DIG. 47

[56] References Cited

U.S. PATENT DOCUMENTS 5,252,798 10/1993 Kamada ..... 200/313
5,280,145 1/1994 Mosier et al. ..... 200/314

FOREIGN PATENT DOCUMENTS 1352549 11/1987 United Kingdom ..... 200/314

*Primary Examiner*—Henry J. Recla
*Assistant Examiner*—David J. Walczak
*Attorney, Agent, or Firm*—Jimmy L. Funke

[57] ABSTRACT

A backlit component which is suitable for use in an illuminated graphic keypad in an instrument panel of an automobile The backlit component is adapted to be illuminated by a light source located beneath the keypad, but off to one side of the backlit component in order to accommodate an actuator member extending from the backlit component and an electrical switch actuated by the actuator member when the backlit component is pressed. The backlit component is formed from an optically conductive material to enable light emitted by the light source to be transmitted through the component to an insignia formed on the exposed or exterior surface of the component. The backlighting intensity of the backlit component is enhanced by forming the actuator member from an optically conductive material, and equipping the actuator member with a reflective surface such that light emitted from the light source is reflected toward the insignia. The actuator member is also equipped with a contact surface for actuating the electrical switch. As such, the backlit component is configured for optimal use of the available light in order to produce the backlighting effect desired for a given application.

17 Claims, 1 Drawing Sheet

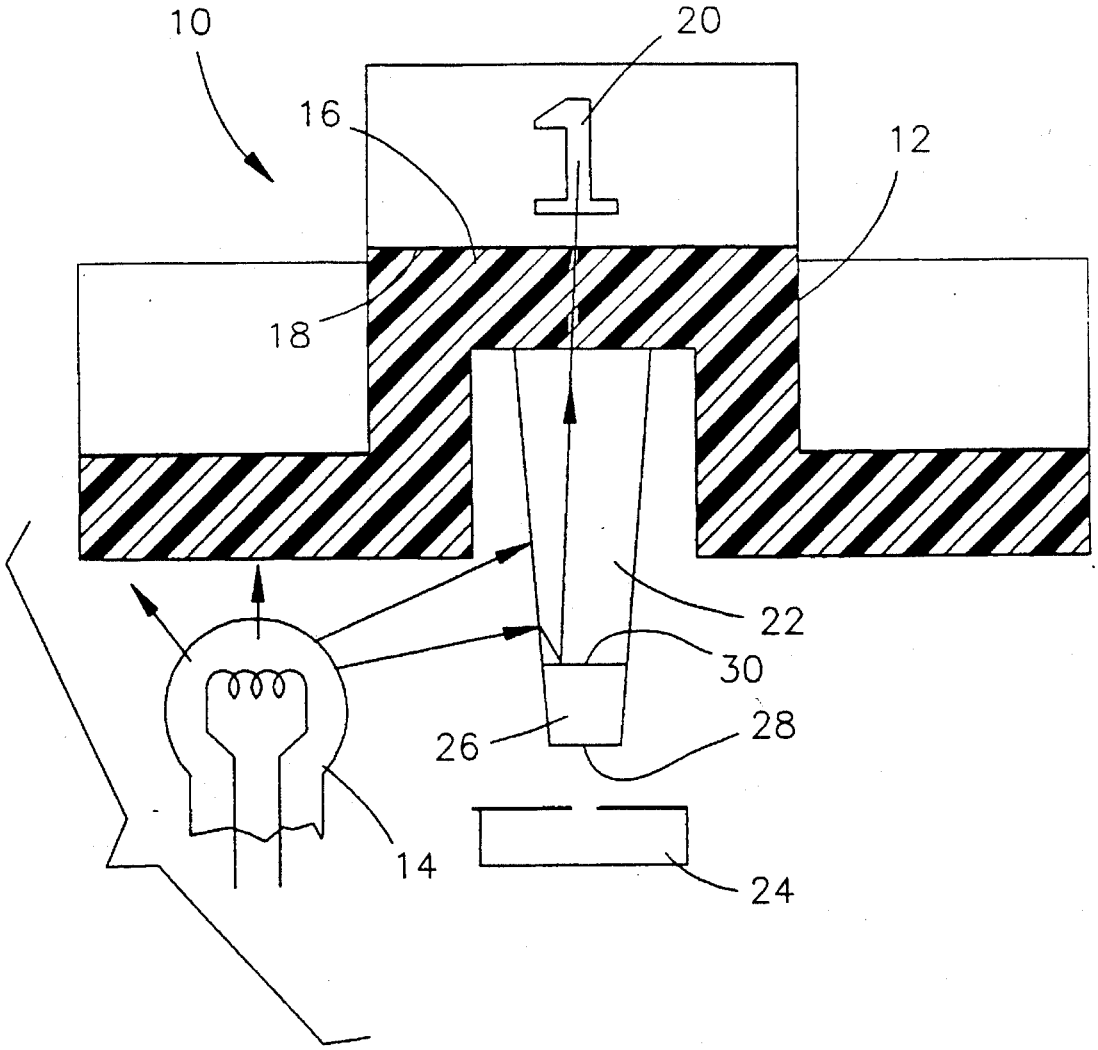
10
20
16
12
18
22
30
26
28
14
24

KEYPAD HAVING A REFLECTIVE CONTACT

The present invention generally relates to illuminated graphic displays and buttons used on instrument panels of automobiles, More particularly, this invention relates to a keypad having an actuator with which a switch is operated, wherein the actuator includes a reflective surface which reflects light from a nearby light source toward an insignia formed on the surface of the keypad.

BACKGROUND OF THE INVENTION

Illuminated graphic keypads for automotive applications such as radios often have backlit insignia which identify the particular function of each button. Such backlit keypads employ a light source which is positioned behind the keypad in order to make the insignia visible in the dark, necessitating that the insignia be capable of receiving light from the light source. For this purpose, the keypad buttons are typically formed from a light conducting material, i.e., transparent and translucent materials.

A known process for manufacturing buttons and other backlit components is the use of paint and laser technology. These processes have generally involved forming the button from a transparent plastic material which may be painted white to form a white translucent layer over the transparent material, and then painted black to form an opaque black covering over the transparent material and, if present, the white translucent layer. The black covering is then lased away to form an insignia. The transparent nature of the button maximizes the transmission of light through the button for night time viewing. If present, the white translucent layer contributes graphics whiteness by reflecting light, such that the insignia is more readily visible under natural lighting conditions during daylight hours.

Paint and laser techniques of the type noted above have significant shortcomings. Insignias typically used in automobile graphic keypads have a stroke width (the line width of the insignia) of often less than one millimeter. Obtaining suitable optical characteristics with such intricate graphics requires controlling the thicknesses of the light conducting structures in order to maintain the desired lighting effect through the insignia. The ability to achieve a desired lighting effect is typically further complicated by the requirement for the backlit component to actuate an electrical switch beneath the keypad. Operation of the switch and efficient use of light sources often dictate that a light source cannot be located directly beneath a backlit component. Consequently, it can be difficult to achieve an adequate and uniform distribution of light to the backlit buttons of a keypad.

Even if uniform intensity is achieved within a single backlit component, differences in adjacent insignia often result in irregular illumination intensities within a backlit display group. This is particularly true with buttons of a backlit display which share one or more light sources. To minimize costs, such groupings often use a minimum number of light sources, and incorporate light pipes for the purpose of distributing the light energy equally to each of the backlit buttons.

Although much effort has been directed toward optimizing the design of light pipes, uniform backlighting of each and every backlit component is very difficult due to size and location restraints. As a result, facets and painted patterns have often been applied to light pipes in order to increase the light intensity directed to relatively dim areas. If additional lamps are used, excessively bright areas must be attenuated with printed halftone patterns behind the individual insignia. While such tactics have been effective for flat screen printed displays, it is costly and poorly suited for buttons and other backlit components which are not flat and have low lighting intensities.

Accordingly, it would be desirable to provide a backlit component whose structure is adapted to achieve a sufficient level of backlighting intensity by making efficient use of a minimal number of light sources.

SUMMARY OF THE INVENTION

It is an object of this invention to provide a keypad composed of one or more backlit components which are characterized by minimal variability in backlighting intensity.

It is a further object of this invention that such a backlit component be formed of a translucent material which permits light emitted from a light source to be transmitted to an insignia on the surface of the backlit component.

It is another object of this invention that such a backlit component be equipped with an actuator member to operate an electrical switch, wherein the actuator member maximizes the transmission of light from the light source to the insignia, so as to promote the efficient use of the light available to the backlit component.

In accordance with a preferred embodiment of this invention, these and other objects and advantages are accomplished as follows.

According to the present invention, there is provided a backlit component which is suitable for use in an illuminated graphic keypad in an instrument panel of an automobile. In particular, the backlit component can be a non-flat molded plastic button for use in a display group forming a keypad. The backlit component is adapted to be illuminated by a light source located beneath the keypad, but off to one side of the backlit component in order to accommodate an actuator member which extends from the backlit component and an electrical switch which is operated by the actuator member when the backlit component is pressed.

The backlit component is preferably formed from an optically conductive material to enable light emitted by the light source to be transmitted through the component to an insignia formed on an exposed or exterior surface of the component. The insignia can be defined on the surface of the component through an opening in a coating formed over the component, such that a portion of the component is exposed through the opening.

In accordance with this invention, the backlighting intensity of the backlit component is enhanced by forming the actuator member from an optically conductive material, and equipping the actuator member with a reflective surface such that light emitted from the light source is reflected toward the insignia. A portion of the actuator member is also configured to serve as a contact for the electrical switch, so as to operate the electrical switch by either actuating the switch or providing electrical continuity through the switch. As such, the actuator member is configured to perform two functions: operating the electrical switch for the backlit component, and ensuring that sufficient light is transmitted to the insignia. As a result, the backlighting intensity of a backlit component is less dependent on the proximity, intensity or geometry of its light source. Instead, the backlit component is configured for optimal use of the available light in order to produce the backlighting effect desired for a given application.

As a result, an additional advantage of the present invention is that the backlit component is relatively uncomplicated to manufacture. Generally, a molding operation can be employed to form the backlit component and simultaneously mold-in suitable materials or components for forming the reflective surface and contact. Alternatively, the reflective surface and contact can be formed by various other methods, including depositing ink compositions onto a suitable surface of the actuator member, or impregnating the actuator member with suitable materials.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which a backlit component in accordance with this invention is shown in cross-section.

DETAILED DESCRIPTION OF THE INVENTION

The present invention is directed toward illuminated graphic keypads composed of molded plastic backlit components, such as the non-flat backlit key 10 shown in the FIGURE, which often serve as interior controls for an instrument panel of an automobile. The invention entails a backlit key 10 which is configured to optimize its use of available light in order to produce the backlighting effect required for a given application.

For illustrative purposes, the backlit key 10 is shown in the FIGURE as including a single button 12 and a single light source 14 located below and to one side of the button 12. Alternatively, the light source 14 could be further spaced from the backlit key 10, with a light pipe (not shown) serving to deliver the light from the remote light source 14 to a location closer to the button 12.

Those skilled in the art will recognize that the configuration shown in the FIGURE is merely one example of numerous possible arrangements, in which one or more backlit components are illuminated by one or more light sources, optionally in cooperation with one or more light pipes of any one of numerous designs and configurations. The specific characteristics of the light source 14 and any light pipe employed are not generally features of this invention, and the numerous possible variations in their design are generally within the knowledge and skill of those skilled in the art, as well as within the scope of this invention.

Also schematically shown is an electrical switch 24 through which continuity is achieved by actuating the button 12. As such, the switch 24 is shown in the FIGURE as being located immediately below the button 12. Alternatively, the switch 24 could be offset or spaced further from the backlit key 10. Those skilled in the art will recognize that the switch 24 schematically illustrated in the FIGURE could have numerous other possible configurations, including capacitive switches and those having a contact which is physically actuated by the button 12. The construction and operation of the switch 24 are not features of this invention, and the numerous possible variations in its design are generally within the knowledge and skill of those skilled in the art.

The button 12 is shown as having a structure which is compatible with the teachings of this invention. The button 12 is generally composed of an optically conductive material, i.e., an optically translucent or transparent material, which forms a substrate 16 over which a suitable opaque cover layer 18 is formed. Portions of the underlying substrate 16 are exposed by openings in the cover layer 18 so as to define an insignia 20 on the surface of the button 12. With this arrangement, light transmitted through the substrate 16 will render the insignia 20 clearly visible to an observer for night or daytime viewing.

However, as can be seen in the FIGURE, the button 12 includes an actuator 22 which is integrally formed with the button 12 and extends downwardly from the interior surface of the button 12 toward the electrical switch 24. In this location, the actuator 22 would reduce the amount of light which could be transmitted to the insignia 20 via the substrate 16, even if the actuator 22 were formed from the same optically conductive material as the substrate 16.

As a key aspect of this invention, the actuator 22 is formed from an optically conductive material, and is further equipped with a pill 26 which, in a preferred embodiment, forms both a contact 28 and an optically reflective surface 30. Alternatively, the contact 28 and the reflective surface 30 could be formed by separate members disposed in or on the actuator 22, such as a pair of films or coatings, instead of the unitary pill 26 shown in the FIGURE. Depending on the type of switch 24 to be operated, the pill 26 can be formed from a conductive or nonconductive body which can be equipped or coated to form the reflective surface 30.

The contact 28 preferably forms an exterior surface of the actuator 22 such that the contact 28 can operate the switch 24. The contact 28 can be electrically conductive or nonconductive, depending on the operation of the switch 24. While shown as the distal end surface of the actuator 22, it is foreseeable that the contact 28 could be located elsewhere on the actuator 22 if necessary to operate a switch whose structure and/or operation differs from the switch 24 shown in the FIGURE.

The reflective surface 30 is disposed as shown on the actuator 22, such that light which impinges the reflective surface 30 will be transmitted upwardly through the actuator 22 and the substrate 16 to the insignia 20. Furthermore, light which is scattered within the actuator 22 due to its imperfect optical properties is also redirected by the reflective surface 30 toward the insignia 20. As such, much of the light transmitted to the insignia 20 passes through the actuator 22 as a result of the presence of the reflective surface 30 within the actuator 22. While shown as an embedded surface near the distal end of the actuator 22, it is foreseeable that the reflective surface 30 could be located elsewhere within the actuator 22, or possibly as an exterior surface of the actuator 22, depending on the shapes of the actuator 22 and button 12 and the location of the light source 14 relative to the button 12.

In a preferred embodiment, the substrate 16 and actuator 22 are integrally formed by a liquid injection molding process from a translucent polymeric material, such as an optically clear silicone, though other suitable polymeric materials could foreseeably be used. For purposes of this invention, the substrate 16 and actuator 22 must be sufficiently translucent in order to have a suitable light transmission capability, so as to enable light from the light source 14 to be transmitted to the insignia 20. A particularly suitable material has been found to be two-component liquid injection silicone compositions available from General Electric, and denoted by General Electric as its LIM series of compositions. Preferred LIM compositions produce a key 10 having a hardness range of about Shore A 30 to about Shore A 70, though lower and higher hardnesses can be employed in order to tailor the physical and mechanical properties of the button 12 for a particular application.

The pill 26 is preferably formed by screening or spray painting an ink composition onto the end of the actuator 22. Such techniques are known in the art, and various suitable ink compositions are known and commercially available. The ink composition may be conductive or nonconductive, depending on the operation of switch 24 used. Alternatively, the pill 26 could be formed with an insert that is either insert molded to the end of the actuator 22 during the molding process, or bonded to the end of the actuator 22 with a suitable adhesive. Preferred materials for such inserts include conductive and nonconductive extruded rubber materials which are known and commercially available. In addition, the pill 26 and contact 28 could also be formed by impregnating the end of the actuator 22 with a suitable material, such as gold, silver or iron alloys.

Notably, the reflective surface 30 of the pill 26 need not be produced as a result of the inherent reflectivity of the pill material, but can be achieved by a suitably reflective coating which is applied to the surface of the pill 26. Forming the reflective surface 30 with a reflective coating enables the pill 26, and thus the contact 28, to be formed from a wide variety of materials, including highly conductive materials such as copper or copper alloys. Again, the contact 28 and the reflective surface 30 could alternatively be formed by separate bodies, coatings or layers disposed in or on the actuator 22, instead of the unitary pill 26 shown in the FIGURE.

The cover layer 18 can be any suitable coating material which exhibits the required capability of providing correct opacity, gloss and color within a thickness range suitable for production. Preferred materials for the cover layer 18 are known silicone-based coatings. One or more layers of such materials can be used to form the cover layer 18, as may be desired for a particular application. These materials can be readily lased to form the insignia 20.

As is apparent from the previous description, the presence of the reflective surface 30 significantly promotes the backlighting intensity of an illuminated keypad 10 through more efficient use of the available light produced by the keypad's light source 14. As a result, improved backlighting intensity can be achieved without increasing the light available to the key 10. Alternatively, backlighting intensity can be maintained while reducing the amount of light available to the key 10.

It can also be seen that an advantage of the present invention is that the proximity of the light source 14 to the button 12 is not as critical as with prior art keys. In particular, the light source 14 need not be positioned directly beneath the button 12, but can be further offset from the button 12, in that the reflective surface 30 will tend to redirect light absorbed or scattered by the actuator 22 toward the insignia 20. Under extreme conditions, substantially all of the light transmitted to the insignia 20 could be transmitted through the actuator 22 by reflection off the reflective surface 30, as suggested by the FIGURE. By allowing for less stringent placement of light sources, a graphics illuminated keypad can be more quickly developed, enabling shorter lead times and at lower costs.

Generally then, a significant advantage of this invention is that keypads for a display panel can be more readily mass produced to exhibit significantly improved backlighting intensities, due to the backlighting effect being promoted by the ability of the reflective surface 30 to capture and redirect light toward the insignia 20 of the button 12. In doing so, the placement and arrangement of light sources behind the display becomes less critical, allowing for greater design flexibility when laying out a graphics illuminated keypad.

While our invention has been described in terms of a preferred embodiment, it is apparent that other forms could be adopted by one skilled in the art, for example by adopting processing methods other than those suggested here, or by substituting appropriate materials. Accordingly, the scope of our invention is to be limited only by the following claims.

The embodiments of the invention in which an exclusive property or privilege is claimed are defined as follows:

1. A backlit component adapted to be located proximate a light source and an electrical switch, the backlit component comprising:

a button member formed of an optically conductive material, the button member having an exterior surface;

an insignia formed on the exterior surface of the button member such that light is transmitted through the optically conductive material to the insignia; and an actuator member extending from the button member for operating the electrical switch, at least a portion of the actuator member being formed from an optically conductive material and having a surface impinged by light emitted by the light source, the actuator member having a reflective surface defined by a reflective coating positioned within said actuator member and adapted to reflect light transmitted through the surface of the actuator member from the light source, such that at least a portion of the light transmitted through the surface is reflected through the actuator member toward the insignia, the actuator member having a contact member disposed on the actuator member for closing and opening the electrical switch.

2. A backlit component as recited in claim 1 wherein the reflective surface and the contact member are disposed at a distal end of the actuator member.

3. A backlit component as recited in claim 1 further comprising a body associated with the actuator member, the body forming the contact member and the reflective surface.

4. A backlit component as recited in claim 1 wherein the contact member forms an electrically conductive surface.

5. A backlit component as recited in claim 1 further comprising the electrical switch.

6. A backlit component as recited in claim 1 further comprising the light source.

7. A backlit component as recited in claim 1 wherein the contact member forms a distal end surface of the actuator member.

8. A backlit component located proximate a light source and an electrical switch, the backlit component comprising:

a button member formed of an optically conductive material, the button member having an exterior surface and an interior surface;

an insignia formed on the exterior surface of the button member such that light is transmitted through the optically conductive material to the insignia;

an actuator member extending from the interior surface of the button member for operating the electrical switch, the actuator member being formed from an optically conductive material and having an external surface impinged by light emitted by the light source, the actuator member having a distal end adjacent the electrical switch;

a member supported with the actuator member, the member having a reflective surface disposed between the member and the optically conductive material of the actuator member so as to reflect light transmitted through the external surface of the actuator member from the light source, such that at least a portion of the light transmitted through the external surface is reflected through the actuator member toward the insignia, the member further having a contact surface for engaging the electrical switch and thereby closing and opening the electrical switch.

9. A backlit component as recited in claim 8 wherein the contact surface is an electrically conductive surface.

10. A backlit component as recited in claim 8 further comprising a coating on the exterior surface of the button member, the insignia being defined by an opening in the coating such that a portion of the button member is exposed through the opening.

11. A backlit component as recited in claim 10 wherein the reflective surface is defined by a reflective coating.

12. A backlit component as recited in claim 8 wherein the member is disposed at the distal end of the actuator member.

13. A backlit component as recited in claim 8 further comprising the electrical switch.

14. A backlit component as recited in claim 8 further comprising the light source.

15. A keypad having at least one backlit component, the keypad comprising:

a button member formed of an optically conductive material, the button member having an exterior surface and an interior surface;

a light source in proximity to the button member so as to project light toward the interior surface of the button member;

an electrical switch in proximity to the interior surface of the button member;

an insignia formed on the exterior surface of the button member such that light is transmitted from the light source through the optically conductive material to the insignia;

an actuator member extending from the interior surface of the button member toward the electrical switch for actuating the electrical switch, the actuator member having a distal end which forms a distal end surface adjacent the electrical switch, the actuator member being formed of an optically conductive material and having an external surface impinged by light emitted by the light source, such that the light impinging the external surface is transmitted through the external surface and the optically conductive material of the actuator member to the insignia; and a member disposed at the distal end of the actuator member, the member having a reflective surface disposed between the member and the optically conductive material of the actuator member and adapted to reflect the light transmitted through the external surface of the actuator member from the light source, such that at least a portion of the light transmitted through the external surface is reflected through the actuator member toward the insignia, the member further having a contact surface for engaging the electrical switch and thereby opening and closing the electrical switch, the contact surface of the member forming the distal end surface of the actuator member.

16. A backlit component as recited in claim 15 wherein the contact surface is an electrically conductive surface.

17. A backlit component as recited in claim 15 wherein the contact surface is an electrically nonconductive surface.

* * * * *